US006707479B1

(12) United States Patent
Pan et al.

(10) Patent No.: US 6,707,479 B1
(45) Date of Patent: Mar. 16, 2004

(54) APPARATUS AND METHODS OF PRINTING ON AN ELECTRICALLY WRITABLE MEDIUM

(75) Inventors: Alfred I-Tsung Pan, Sunnyvale, CA (US); Steven Rosenberg, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/341,630

(22) Filed: Jan. 14, 2003

(51) Int. Cl.[7] ..... B41J 2/22; F09G 3/34

(52) U.S. Cl. ..... 347/112; 347/153; 400/118.2

(58) Field of Search ..... 347/111, 112, 347/153; 345/107; 359/296; 399/45; 400/118.2, 124.01

(56) References Cited

U.S. PATENT DOCUMENTS 4,588,997 A 5/1986 Tuan et al.
4,768,056 A * 8/1988 Tomoyori et al. ..... 347/141
5,351,995 A 10/1994 Booker
5,389,945 A 2/1995 Sheridon
5,866,284 A 2/1999 Vincent
6,081,285 A * 6/2000 Wen et al. ..... 347/111
6,456,272 B1 9/2002 Howard et al.

OTHER PUBLICATIONS

U.S. patent Publication No. 2002/0131151, Engler et al., Sep. 19, 2002.
U.S. patent Publication No. 2002/0057250, Engler et al., May 16, 2002.

* cited by examiner

*Primary Examiner*—Joan Pendegrass

(57) ABSTRACT

Apparatus and methods of printing on an electrically writable medium are disclosed. In one aspect, a printer for printing on an electrically writable medium includes a print head and a biasing system. The print head has multiple solenoid-actuated print wires that are operable to reciprocate toward and away from the medium. The biasing system is coupled to the print head and is operable to apply through print wires extended toward the medium an electric field greater than a threshold electric field needed to reorient switchable display elements in a localized region of the medium.

26 Claims, 4 Drawing Sheets

APPARATUS AND METHODS OF PRINTING ON AN ELECTRICALLY WRITABLE MEDIUM

TECHNICAL FIELD

This invention relates to apparatus and methods of printing on an electrically writable medium.

BACKGROUND

Many companies are developing electronic paper, which is a display system that retains images with little or no power. Images typically are generated on an electronic paper medium by selectively applying an electric field to switchable display elements (e.g., dichroic spheres) in localized regions of the medium. In a typical implementation, an electrically conductive backplane electrode is placed behind the electronic paper medium and a second electrically conductive front plane electrode is placed in front of the electronic paper medium. Applying an electric field of one polarity to the medium switches the display elements to one orientation (e.g., black-side-up), and reversing the polarity of the applied electric field switches the display elements to a second orientation (e.g., white-side-up). A two-dimensional electrode grid with individually addressable cells may be used to provide an electric field in selected areas of the electronic paper medium. Alternatively, a single electrode may be scanned across the electronic paper as the paper is advanced by a roller system. The electronic paper medium remains in the switched (or "printed") state after the electric field is removed, until a new electric field is applied to change the orientation of the display elements.

One known electrode array printer for printing on rewritable electronic paper includes an array of independently addressable electrodes, each capable of applying a localized field to the rewritable media to rotate dichroic spheres within a given pixel area of a rewritable medium. In another known electrically writable media printing technique, a laser scanner is used to erase a uniform high-voltage charge that was deposited on the surface of a photoconductor drum or belt. The voltage swing between charged and discharged areas of the photoconductor is conventionally on the order of about 500–600 volts. When the rewritable medium is brought in contact with the charge-written photoconductor through a biased back electrode roller, electric fields that are generated between the photoconductor and back electrode cause color rotation of the dichroic spheres to develop a desired print image.

SUMMARY

In one aspect, the invention features a printer for printing on an electrically writable medium. The printer includes a print head and a biasing system. The print head has multiple solenoid-actuated print wires that are operable to reciprocate toward and away from the medium. The biasing system is coupled to the print head and is operable to apply through print wires extended toward the medium an electric field that is greater than a threshold electric field needed to reorient switchable display elements in a localized region of the medium.

In another aspect, the invention features a method of printing on an electrically writable medium in which multiple solenoid-actuated print wires are reciprocated toward and away from the medium. An electric field, which is greater than a threshold electric field needed to reorient switchable display elements in a localized region of the medium, is applied through print wires extended toward the medium.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Multiple embodiments of printers are described in detail below. Each of these printer embodiments is operable to print on electrically writable media. In general, these printer embodiments may print on any type of medium that includes display elements that are electrically switchable in localized regions of the medium to produce an image. Exemplary switchable display elements include bi-stable, dual-color microcapsules, dichroic spheres, and optically anisotropic colorant particles.

Figure 1:
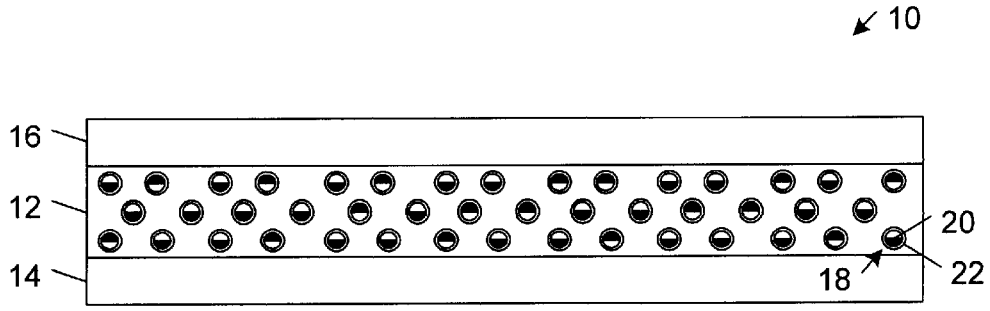
FIG. 1 is diagrammatic cross-sectional side view of an implementation of an electrically writable medium.

Referring to FIG. 1, in some embodiments, an electrically writable medium 10 includes at least one colorant layer 12 that is disposed between a pair of protective layers 14, 16. In the illustrated embodiment, the colorant layer 12 is formed from a polymer binder and a plurality of switchable display elements that are implemented in the form of bi-stable, dual-color microcapsules 18. Each microcapsule 18 includes a solid bi-colored sphere 20 housed in a microencapsulating shell 22. Each microcapsule sphere 20 is coated with a lubricating fluid. Each sphere 20 is colored white on one hemisphere and colored black on the opposing hemisphere. The black colorant may be vapor-deposited, for example, on a solid white sphere that may be made of, for example, a pigmented glass, a polymer, or a ceramic. The vapor deposit contains charge species that give each of the spheres 20 an electric dipole for field alignment. The resulting charge on each bi-colored sphere allows the bi-colored spheres 20 to be oriented in accordance with an applied electric field so that each sphere 20 presents either the white hemisphere face or the black hemisphere face at the top surface of the electrically writable medium. The microcapsules 18 may be supported in a fixed polymer coating layer, while allowing each microcapsule sphere 20 to rotate within the microencapsulating shell 22. The electrically writable medium 10 preferably contains a sufficient density of microcapsules 18 so that the electrically writable medium 10 appears completely white or completely black when all of the microcapsules 18 are oriented in the same direction.

In general, protective layer 14 may be formed of any flexible, fibrous or non-fibrous sheet material. In some embodiments, the protective layer 14 of electrically writable medium 10 has the look and feel of paper, but has far greater durability than most, commonly-used cellulose fiber papers. Such media are known in the art, and commonly consist of polymeric impregnated papers or polymeric fibers woven or assembled into films that have a paper appearance. Examples of such papers include Tyvek® (available from E. I. du Pont de Nemours and Company of Wilmington, Del., U.S.A.) and a series of Master-Flex™ papers (available from Appleton Papers Inc. of Appleton, Wis., U.S.A.).

Top protective layer 16 is optional and may be coated over the colorant layer 12 to increase the durability of electrically writable medium 10. Protective layer 16 may be formed of a transparent polymer, such as PMMA (polymethylmethacrylate), or a blend of polymers. In some embodiments, the polymer binder and microcapsule shells 20 have matching refractive indices to minimize light scattering within the colorant layer 12, improving image contrast. The gloss of the electrically writable medium 10 may be controlled by the characteristics of the colorant layer 12 or the optional protective layer 16, or both. In some embodiments, the refractive indices of protective layer 16 and colorant layer 12 may be mismatched to enhance the "white paper" mode by inducing additional light scattering to enhance whiteness.

Figure 2A:
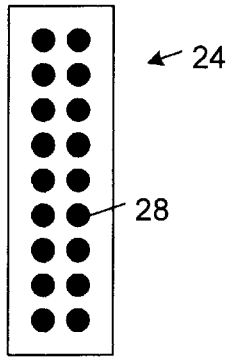
FIG. 2A is a diagrammatic front view of an embodiment of a print head that includes an array of two columns of print wires.
Figure 2B:
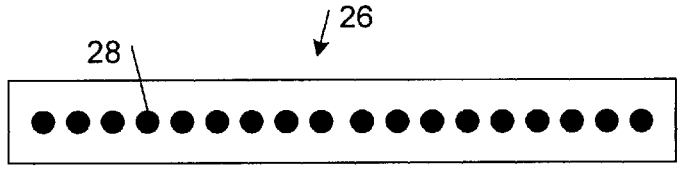
FIG. 2B is a diagrammatic front view of an embodiment of a print head that includes a linear array of print wires.
Figure 2C:
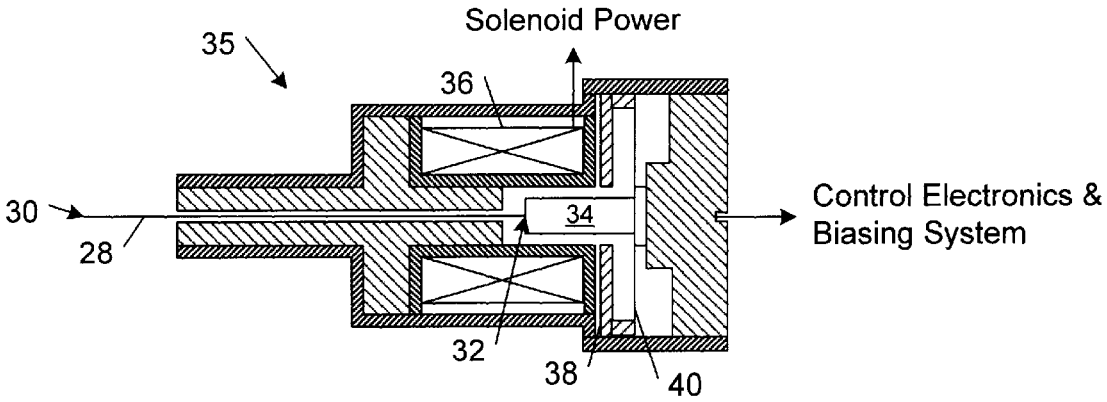
FIG. 2C is a diagrammatic cross-sectional side view of an embodiment of a print wire that is mounted to a solenoid-actuated plunger of a solenoid coil assembly.

Referring to FIGS. 2A–2C, some printer embodiments may incorporate a serial print head 24 that is operable to "print" (or form an image) on electrically writable medium 10. Other printer embodiments may incorporate a linear print head 26. Serial print head 24 and linear print head 26 may correspond to conventional dot matrix print heads that each includes an additional biasing system that is operable to apply through print wires 28 that are extended toward electrically writable medium 10 an electric field that is greater than the threshold electric field need to reorient the switchable display elements of electrically writable medium 10. In the illustrated embodiment, serial print head 24 has an array of eighteen print wires 28 that are arranged in two vertical columns; other embodiments may include a greater number (e.g., 24) or a lesser number (e.g., 7 or 9) of print wires 28. The number of print wires in linear print head 26 also may be different from the eighteen print wires 18 in the illustrated embodiment. Serial print head 24 may be scanned across the width of electrically writable medium 10 so that discrete regions of electrically writable medium 10 may be printed in series; whereas linear print head 26 may be configured to simultaneously print on a linear region extending across the entire width of electrically writable medium 10

As shown in FIG. 2C, in the illustrated embodiment, each print wire 28 has a distal end 30 that is operable to apply an electric field to electrically writable medium 10 and a proximal end 32 that is connected to a plunger 34. Plunger 34 is disposed along the central axis of a cylindrical coil assembly 35 that includes a solenoid coil 36. A ring core 38 limits the outward extension of print wire 28 and a preloaded plunger-restoring disk spring 40 maintains the print wire 28 in a retracted position when the solenoid coil 36 is not energized. In operation, when a printing pulse is applied to the solenoid coil 36, the plunger 34 is attracted to forwardly against the resiliency of disk spring 40. As a result, print wire 28 is driven axially forward into an extended state. Upon termination of the printing pulse, the plunger 34 and the print wire 28 are restored to their initial, rest position under the action of the disk spring 40.

Figure 3:
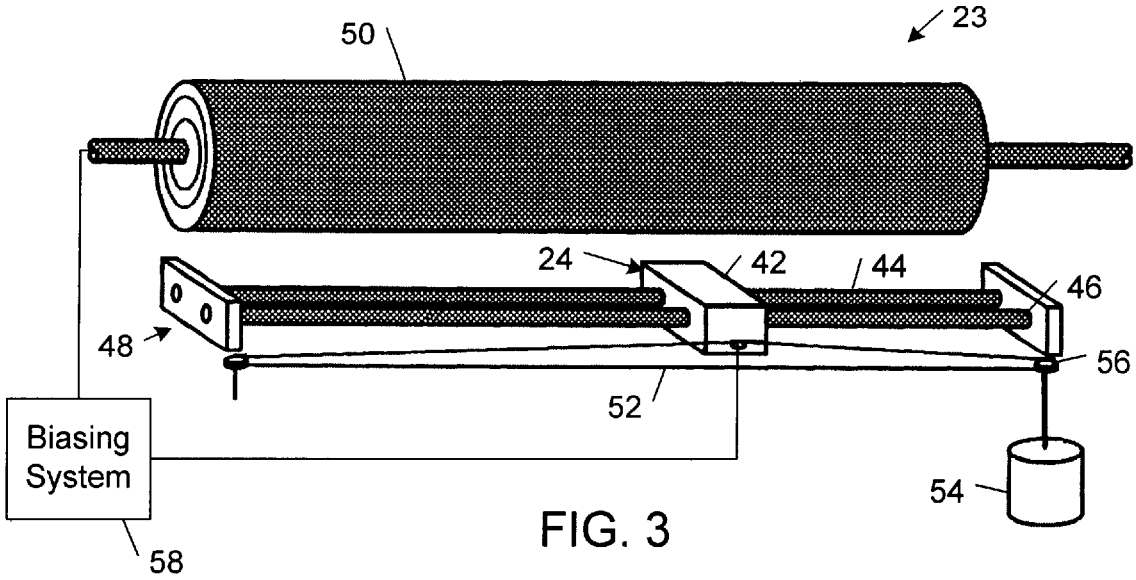
FIG. 3 is a diagrammatic perspective view of an embodiment of a printer that incorporates the print head embodiment of FIG. 2A and a cylindrical platen.

Referring to FIG. 3, in one exemplary embodiment, a printer 23 includes a serial print head 24 that is mounted to a low friction slide 42. Low friction slide 42 is mounted to a pair of carriage rails 44, 46 of a carriage assembly 48. The print head 24 is moved across the length of a cylindrical platen 50 by a belt 52 that is connected to slide 42 and to a drive motor 54 through a drive pulley 56. When the drive motor 54 turns in a clockwise direction the slide 42 is pulled to the right, and when drive motor 54 the motor turns in a counterclockwise direction the slide 42 is pulled to the left. Conventional limit switches may be used to prevent the slide 42 from being pulled too far in either direction. The rotation of feed platen 50 and the drive motor 54 may be controlled by conventional serial printer control electronics (not shown).

A biasing system 58 is coupled to the serial print head 24 through an electrical interface on slide 42 and to platen 50. In the illustrated embodiment, the external surface of platen 50 is electrically conductive. Biasing system 58 is operable to generate between the external platen surface and the distal ends of print wires that are extended toward the platen 50 an electric field that is greater than the threshold electric field needed to reorient the switchable display elements of an electrically writable medium that is disposed between the print head 24 and the platen 50. A wide variety of different voltage combinations may be applied by biasing system 58 to platen 50 and print wires 28 to achieve the necessary electric field strength.

In some embodiments, the print wires 28 are operable to contact an electrically writable medium that is disposed between print head 24 and platen 50. In other embodiments, the print wires 28 are operable to apply the necessary electric field strength without contacting an electrically writable medium that is disposed between the print head 24 and the platen 50. In some embodiments, the biasing system 58 is operable to maintain the print wires 28 in a biased (or "writing") state during the entire printing process. In other embodiments, the biasing system 58 is operable to bias print wires 28 each time they are individually actuated for printing at respective localized regions of the electrically writable medium.

Figure 4A:
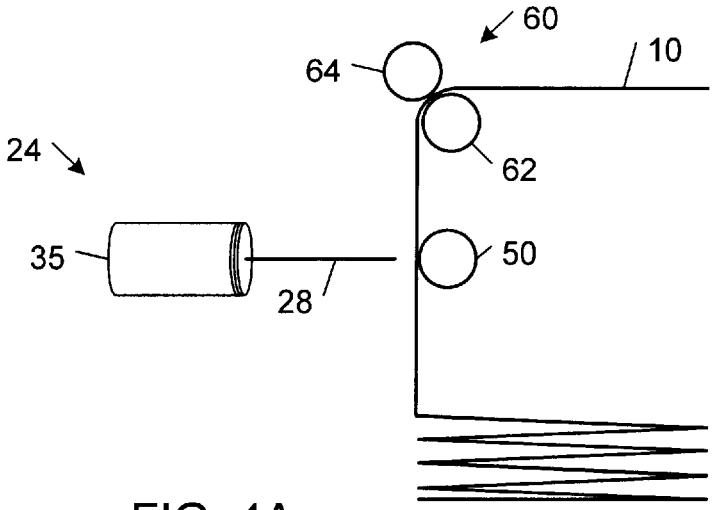
FIG. 4A is a diagrammatic side view of an embodiment of a print wire that is retracted away from a region of an electrically writable medium.
Figure 4B:
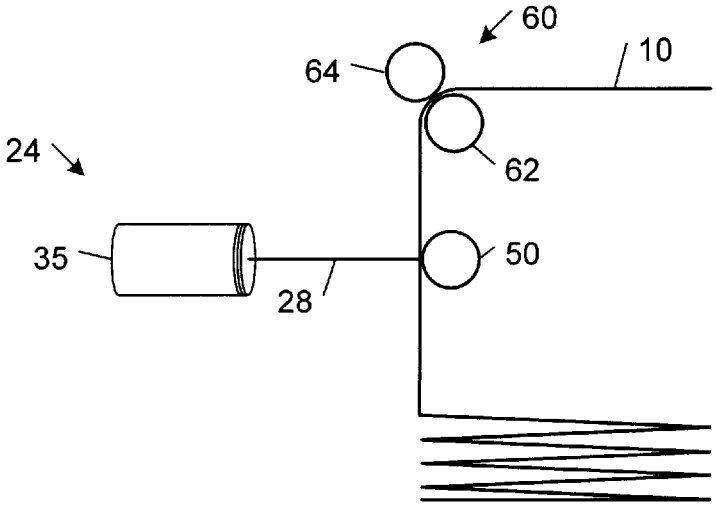
FIG. 4B is a diagrammatic side view of an embodiment of a print wire that is extended toward and is in contact with the medium of FIG. 4A to apply an electric field through a localized region of the medium.

Referring to FIGS. 4A and 4B, in operation, electrically writable medium 10 is fed between print head 24 and platen 50 by a sheet feed system 60 that includes a drive roller 62 and an idler roller 64. As the electrically writable medium 10 is being fed, the print wires 28 are in a retracted state (FIG. 4A) until they are actuated for printing. When a localized region of electrically writable medium 10 is to be printed by a print wire 28, the printer control electronics transmits a printing pulse to the solenoid coil assembly corresponding to the print wire 28. In response, the print wire 28 is driven toward and into contact with the electrically writable medium 10 (FIG. 4B). As explained above, biasing system 58 may maintain the printing wire 28 in a biased state during the entire printing process; alternatively, the biasing system 58 may bias printing wire 28 to an appropriate voltage level only during the time that the printing pulse is applied. After the necessary electric field has been applied to the desired localized region of electrically writable medium 10, the printing pulse is terminated and the print wire 28 is returned to the retracted state (FIG. 4A).

Figure 5:
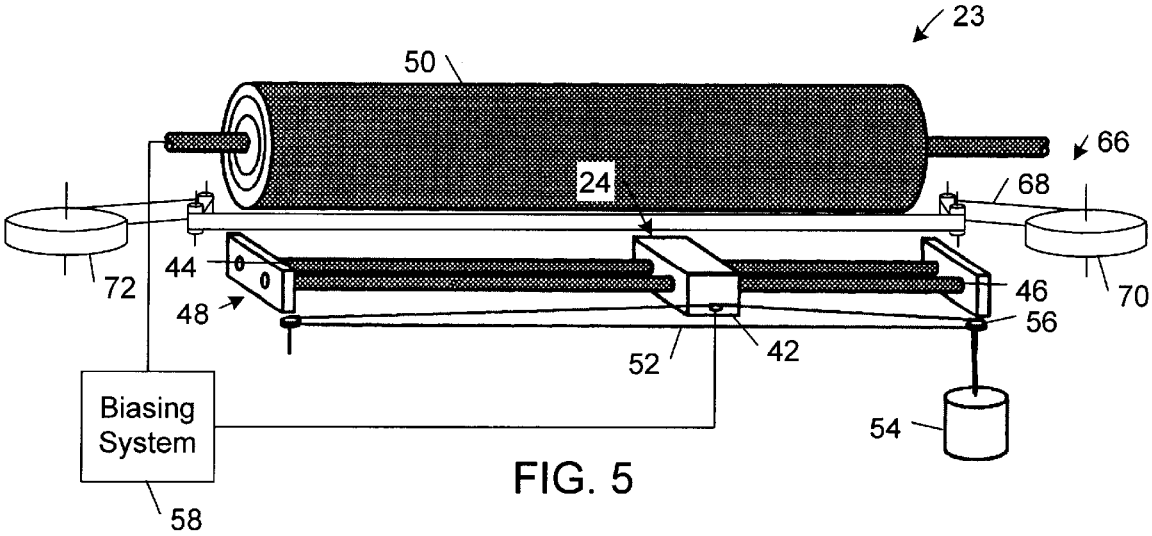
FIG. 5 is a diagrammatic perspective view of the printer embodiment of FIG. 3 with an inked ribbon cartridge holding an inked ribbon between the print head and the platen.

Referring to FIG. 5, in some embodiments, printer 23 includes a conventional, removable inked ribbon cartridge 66 (shown diagrammatically in FIG. 5) that is configured to hold an inked ribbon 68 between platen 50-and print head 24 when mounted within printer 23. Inked ribbon cartridge 66 includes a supply reel 70 for supplying unused inked ribbon and a take-up reel 72 for taking-up used inked ribbon. These embodiments provide a two printing modes that enable printer 23 to print on a wide variety of different substrates, including electrically writable media and conventional paper-like substrates. As used herein, the term "substrate" encompasses any support material that can be printed on either by application of an electric field or by application of a marking substance (e.g., ink). Examples of substrate material can include but are not limited to paper, plastic (e.g., transparency), photographic paper, and electrically writable material. A substrate can come in the form of a sheet or can be a continuous substrate (e.g., paper rolls). In these embodiments, inked ribbon cartridge 66 preferably is mounted in a cartridge assembly that is operable to selectively move the inked ribbon cartridge 66 into and out of position with respect to the print head 24 and the platen 50 based on the type of substrate that is loaded into the printer. For example, if an electrically writable medium is loaded into printer 23, then the cartridge assembly maintains the inked ribbon cartridge 66 in a "standby" position where the inked ribbon 68 is outside of the region between print head 24 and platen 50. On the other hand, if a paper substrate, for example, is loaded into printer 23, then the cartridge assembly moves the inked ribbon cartridge into an "active" position where the inked ribbon 68 is held between the print head 24 and platen 50.

Figure 6A:
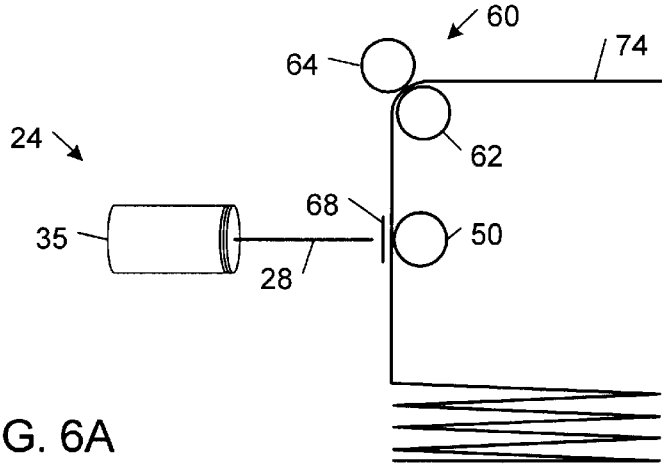
FIG. 6A is a diagrammatic side view of an embodiment of a print wire that is retracted away from an inked ribbon that is disposed between the print wire and a platen.
Figure 6B:
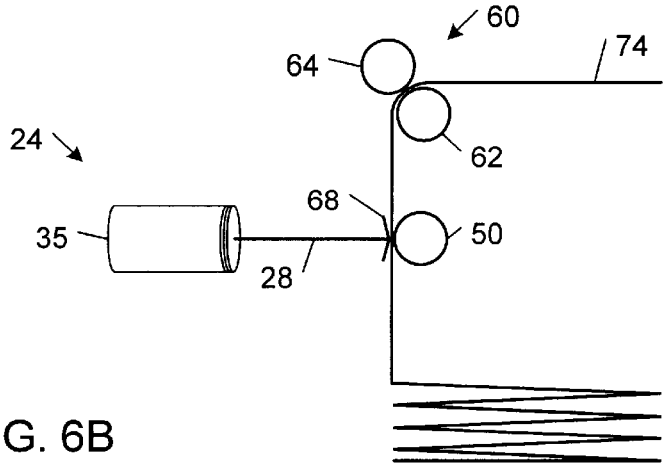
FIG. 6B is a diagrammatic side view of an embodiment of a print wire that is extended toward and is in contact with the inked ribbon of FIG. 6A to impress the inked ribbon against a localized region of a substrate that is disposed between the inked ribbon and the platen.

Referring to FIGS. 6A and 6B, in operation, a conventional substrate 74 (e.g., a conventional sheet of paper) is fed between print head 24 and platen 50 by sheet feed system 60. As the substrate 74 is being fed, the print wires 28 are in a retracted state (FIG. 6A) until they are actuated for printing. When a localized region of substrate 74 is to be printed by a print wire 28, the printer control electronics transmits a printing pulse to the solenoid coil assembly corresponding to the print wire 28. In response the print wire 28 is driven toward and into contact with the inked ribbon 68, impressing the inked ribbon 68 against substrate 74 (FIG. 6B). Biasing system 58 maintains the printing wire 28 in an unbiased state during the entire inked-ribbon-based printing process. After the inked ribbon 66 has transferred a dot of ink onto substrate 74, the printing pulse is terminated and the print wire 28 is returned to the retracted state (FIG. 6A).

In sum, the above-described embodiments may be implemented in a printer system that leverages existing printer technology with improvements that enable printing on a wide variety of different types of electrically writable media. In addition, some embodiments provide dual modes of printing in which the printer system is operable to print on both electrically writable media and conventional paper-like substrates.

Other embodiments are within the scope of the claims.

For example, although the above embodiments are described in connection with one exemplary type of electrically writable medium, these embodiments readily may be used with other types of electrically writable media, including electrically writable media that incorporate optically anisotropic particles having one or more colors in addition to or replacing one or more of the black and white colors, and electrically writable media in which protective layer 14 is electrically conductive and forms an electrically conductive backplane. In some printer embodiments that are designed for use with electrically writable media that have electrically-conductive backplanes, the external surface of platen 50 may be electrically-insulating.

In addition, although the above embodiments are described in connection with exemplary print head designs, other embodiments may be used with different print head designs.

Figure 7:
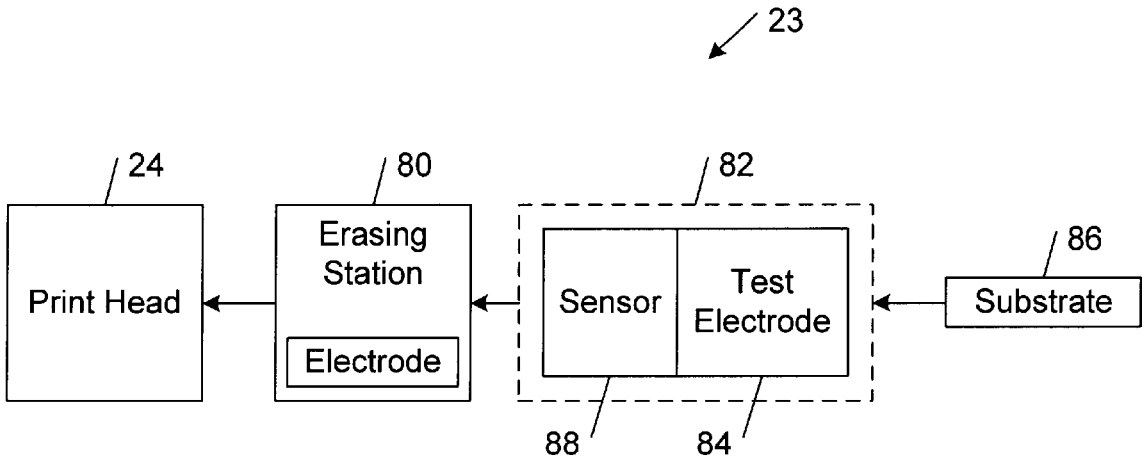
FIG. 7 is a block diagram of a printer that includes a substrate type detector, an erasing station, and a print head.

Referring to FIG. 7, some embodiments may include upstream of the print head 24 a substrate type detector 82 that is operable to detect whether an electrically writable medium or a conventional print medium has been loaded for printing. For example, substrate type detector 82 may include a test electrode 84 that applies a bias to mark (e.g., produce a discernable color change in a localized region) a substrate sheet 86 that is being fed through the printer 23. A sensor 88 (e.g., a photodetector), which is positioned downstream of the test electrode 84, may detect whether the applied bias produced a test mark on the substrate and produce a signal indicative of the type of substrate that is loaded into the printer for printing. If the test mark is detected, the inked ribbon cartridge 66 is moved to the standby position before the print head 24 is used to print on the substrate. If the test mark is not detected, the inked ribbon cartridge 66 is moved to the active position before the print head 24 is used to print on the substrate.

As shown in FIG. 7, some embodiments may include an upstream erasing station 80 that includes, for example, a charged-electrode that is biased to orient all of the switchable display elements of an electrically writable medium in the same direction (e.g., white sides facing up) before an image is printed on the medium.

Figure 8:
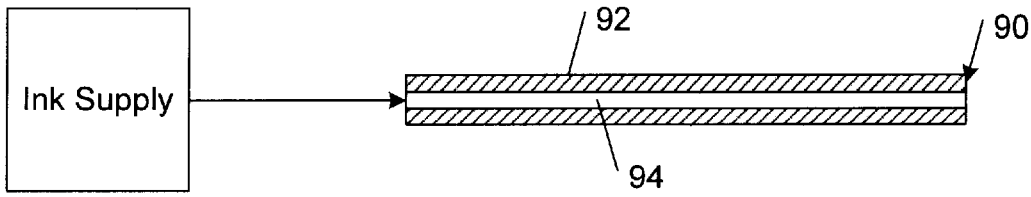
FIG. 8 is a diagrammatic view of an ink supply coupled to a print wire that has an ink supply channel for delivering ink to a substrate.

Referring to FIG. 8, instead of being based on inked-ribbon ink delivery systems, some dual-mode printer embodiments may be implemented based on ink-supplied wire printing systems in which ink is supplied to distal ends 90 of print wires 92 through respective ink channels 94. The ink that is delivered to the distal ends 90 of print wires 92 may be applied directly to a substrate by selectively reciprocating print wires 92 into and out of contact with the substrate.

What is claimed is:

1. A printer for printing on an electrically writable medium, comprising:

a print head having multiple solenoid-actuated print wires operable to reciprocate toward and away from the medium; and a biasing system coupled to the print head and operable to apply through print wires extended toward the medium an electric field greater than a threshold electric field needed to reorient switchable display elements in a localized region of the medium.

2. The printer of claim 1, wherein the print wires are operable to contact the medium.

3. The printer of claim 1, wherein the print wires are operable to apply to the medium an electric field greater than the threshold electric field without contacting the medium.

4. The printer of claim 1, further comprising a platen.

5. The printer of claim 4, wherein the platen is electrically conductive.

6. The printer of claim 4, wherein the platen comprises a rotatable cylinder.

7. The printer of claim 4, further comprising an inked ribbon cartridge configured to hold an inked ribbon between the platen and the print head.

8. The printer of claim 7, wherein the print wires are operable to impress the inked ribbon against a substrate disposed between the inked ribbon and the platen.

9. The printer of claim 7, further comprising a cartridge assembly operable to selectively move the inked ribbon cartridge in and out of position with respect to the print head.

10. The printer of claim 9, further comprising a substrate type detector operable to produce a signal indicative of type of substrate loaded into the printer.

11. The printer of claim 10, wherein the inked ribbon carriage assembly is moved into and out of position with respect to the print head based on the signal produced by the substrate type detector.

12. The printer of claim 7, wherein the biasing system is operable to maintain the print wires in an unbiased state when the inked ribbon cartridge is positioned for marking a substrate.

13. The printer of claim 1, further comprising a carriage assembly operable to reciprocate the print head in a direction parallel to the medium.

14. The printer of claim 13, wherein the print head comprises an array of one or more columns of print wires oriented in a direction transverse to the direction in which the print head is reciprocated.

15. The printer of claim 1, wherein the print head comprises a linear array of parallel print wires.

16. The printer of claim 1, wherein the biasing system is operable to maintain the print wires in a biased state during printing on the electrically writable medium.

17. The printer of claim 1, wherein the biasing system is operable to bias only print wires actuated for printing on the electrically writable medium.

18. The printer of claim 1, wherein the switchable display elements are bi-stable, dual-color microcapsules, dichroic spheres, or optically anisotropic colorant particles.

19. The printer of claim 1, wherein the electrically writable medium includes an electrically conductive backplane.

20. The printer of claim 1, wherein the print wires include an ink supply channel for delivering ink to a substrate.

21. The printer of claim 1, further comprising an electrode located upstream of the print head and operable to orient all of the switchable display elements in a common direction.

22. A method of printing on an electrically writable medium, comprising:

reciprocating multiple solenoid-actuated print wires toward and away from the medium; and applying through print wires extended toward the medium an electric field greater than a threshold electric field needed to reorient switchable display elements in a localized region of the medium.

23. The printing method of claim 17, wherein reciprocating print wires comprises moving print wires into and out of contact with the medium.

24. The printing method of claim 17, wherein the electric field greater than the threshold electric field is applied without contacting print wires against the medium.

25. The printing method of claim 17, further comprising reciprocating print wires against an inked ribbon to impress the inked ribbon against a substrate.

26. The printing method of claim 20, further comprising producing a signal indicative of type of substrate loaded for printing, and moving the inked ribbon into and out of position between the print wires and the substrate based on the signal produced.

* * * * *